US012680744B2

(12) United States Patent
Brehm

(10) Patent No.: US 12,680,744 B2
(45) Date of Patent: Jul. 14, 2026

(54) FLASH TANK OVERFLOW WARNING SYSTEM

(71) Applicant: Rheem Manufacturing Company, Atlanta, GA (US)

(72) Inventor: John Kevin Brehm, Dallas, TX (US)

(73) Assignee: Rheem Manufacturing Company, Atlanta, GA (US)

( * ) Notice: Subject to any disclaimer, the term of this patent is extended or adjusted under 35 U.S.C. 154(b) by 184 days.

(21) Appl. No.: 18/815,331

(22) Filed: Aug. 26, 2024

(65) Prior Publication Data

US 2025/0075955 A1 Mar. 6, 2025

Related U.S. Application Data

(60) Provisional application No. 63/580,065, filed on Sep. 1, 2023.

(51) Int. Cl.
*F25B 43/00* (2006.01)
*F25B 40/02* (2006.01)
*F25B 49/02* (2006.01)

(52) U.S. Cl.
CPC ..... *F25B 49/02* (2013.01); *F25B 40/02* (2013.01); *F25B 43/006* (2013.01); *F25B 2400/0409* (2013.01); *F25B 2400/16* (2013.01); *F25B 2400/23* (2013.01); *F25B 2500/23* (2013.01); *F25B 2500/31* (2013.01); *F25B 2700/1931* (2013.01); *F25B 2700/1933* (2013.01); *F25B 2700/21152* (2013.01)

(58) Field of Classification Search
CPC ..... F25B 2500/23; F25B 2500/31
See application file for complete search history.

(56) References Cited

U.S. PATENT DOCUMENTS 5,174,123 A * 12/1992 Erickson ..... F25B 1/047 62/278
7,275,385 B2 * 10/2007 Abel ..... F25B 1/04 62/324.4
9,951,974 B2 * 4/2018 Huff ..... F25B 1/10
2005/0262873 A1 * 12/2005 Hirota ..... F25B 43/006 62/503
2013/0255289 A1 * 10/2013 Jung ..... F25B 43/00 62/115

* cited by examiner

*Primary Examiner* — Jerry-Daryl Fletcher
*Assistant Examiner* — Daniel C Comings
(74) *Attorney, Agent, or Firm* — Eversheds Sutherland (US) LLP

(57) ABSTRACT

A flash tank overflow warning system for refrigeration systems and cold climate heat pumps. Some embodiments may include heat pump systems that have a compressor, a condenser, and a flash tank. A vapor injection line may be disposed between the flash tank and the compressor to direct vapor refrigerant from the flash tank to the compressor. A warning line may be coupled to a side surface of the flash tank and may be disposed between the flash tank and the vapor injection line. The vertical attachment position of the warning line on the side surface may determine a ratio of vapor to liquid refrigerant in the flash tank. The warning line may prevent overcharging during the active charging process by an operator (e.g., an HVAC technician, etc.). For example, once the warning system triggers, the operator would stop charging and may or may not release a little bit of refrigerant to achieve an ideally charged system.

20 Claims, 6 Drawing Sheets

FLASH TANK OVERFLOW WARNING SYSTEM

CROSS-REFERENCE TO RELATED APPLICATION

This application claims the benefit of U.S. Application Ser. No. 63/580,065, filed Sep. 1, 2023, the entirety of which is hereby incorporated by reference.

FIELD

This disclosure relates generally to heat pump systems and, more particularly, relates to a flash tank overflow warning system in heat pump or refrigeration systems.

BACKGROUND

In general, heat pump systems utilized in cold climates typically use accumulators or flash tanks in vapor compression cycles with vapor injection. In some instances, heat pump systems need to be charged. Typically, heat pump systems are charged using refrigerant. Charging a heat pump system having a flash tank is often performed manually using calculations based on manufacturer-provided charge tables. Therefore, human error is not uncommon when charging a heat pump system with a flash tank, which can lead to overcharging of the heat pump system. Additionally, the manufacturer provided charge table may be inaccurate which can impact reliability and efficiency. When a heat pump system with a flash tank is overcharged, the flash tank may be filled to capacity, resulting in excess liquid refrigerant in the flash tank. This causes some or all of the liquid refrigerant from the flash tank to be injected into the vapor injection port of the compressor when vapor injection is active, which can damage or destroy the compressor. To address this situation, a liquid line measurement sensor may be coupled to the flash tank in order to monitor the amount of liquid refrigerant in the flash tank and to detect the presence of excess liquid refrigerant in the flash tank. However, such sensors are costly and difficult to install. Therefore, there is a need for a flash tank overflow warning system that can be used in both large industrial systems as well as residential systems.

BRIEF DESCRIPTION OF THE DRAWINGS

The detailed description is set forth with reference to the accompanying drawings. In some instances, the use of the same reference numerals may indicate similar or identical items. Various embodiments may utilize elements and/or components other than those illustrated in the drawings, and some elements and/or components may not be present in various embodiments. Throughout this disclosure, depending on the context, singular and plural terminology may be used interchangeably.

DETAILED DESCRIPTION

Figure 1:
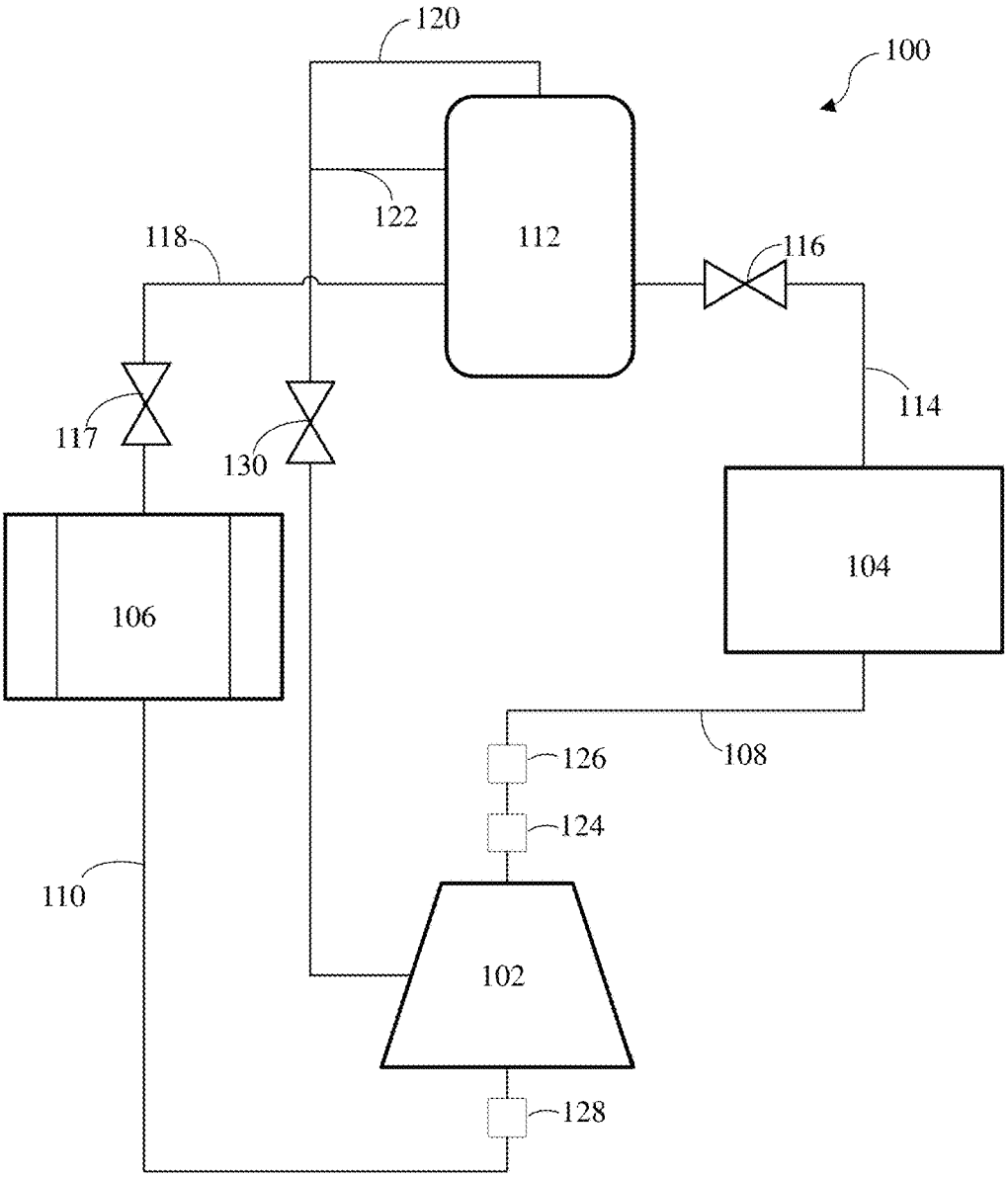
FIG. 1 is a schematic block diagram of a cold climate heat pump system.

This disclosure relates generally to heat pump systems with flash tanks and, more particularly, relates to a flash tank overflow warning system in heat pump systems operating in cold climates and refrigeration systems. Heat pump systems are used for heating and cooling air in an enclosed space. In cold climates, heat pump systems utilize flash tanks or accumulators in vapor compression cycles with vapor injection to cool the compressor of the heat pump system. Because charging of heat pump systems with flash tanks is a manual process that is reliant on calculations and manufacturers' charge tables, recharging a heat pump system with a flash tank often leads to undercharging or overcharging the heat pump system due to miscalculation and human error. When the heat pump system is overcharged, the flash tank is full, causing some or all of the liquid refrigerant in the flash tank, rather than the vapor refrigerant, to be injected into the compressor. When undercharged, efficiency and capacity are negatively affected. This could damage or destroy the compressor. To mitigate this issue, flash tanks may have a liquid line sensor to detect if there is excess liquid refrigerant in the flash tank. However, liquid line sensors are costly, difficult to install, and are typically only operable with large industrial equipment. Accordingly, instead of the liquid line sensor, embodiments include a flash tank overflow warning system that prevents the heat pump system from being overcharged, and may reduce the amount of liquid refrigerant that may reach the compressor when there is excess liquid refrigerant in the flash tank. Certain embodiments may also increase the efficiency by allowing the injected refrigerant to be at a certain quality instead of fully vapor.

Some embodiments include a warning line coupled to the flash tank. The warning line can direct excess liquid refrigerant in the flash tank to the compressor to reduce the risk of overcharging the heat pump system. Certain dimensions, such as the vertical attachment position and the diameter of the warning line, can be configured to accommodate different desired ratios of vapor to liquid refrigerant in the flash tank. The warning line may reduce the risk of overcharging the heat pump system, and, in instances where the heat pump system may be overcharged, the warning line may reduce the amount of liquid refrigerant that reaches the compressor by about 80%. The warning line may prevent overcharging during the active charging process by an operator (e.g., an HVAC technician, etc.). For example, once the warning system triggers, the operator would stop charging and may or may not release a little bit of refrigerant to achieve an ideally charged system. The warning line provides a cost effective solution that prevents overcharging of the heat pump system, and potentially extends compressor lifespan by reducing an amount of liquid that is injected into the compressor instead of vapor. Furthermore, because the warning line reduces the risk of overcharging the heat pump system, the size of the flash tank may be reduced, providing additional cost savings and improved system efficiency.

In one embodiment, a heat pump system includes a compressor with a suction port, an injection port, and a discharge port, a condenser coupled to the compressor, and an evaporator coupled to the compressor. A discharge line may be disposed between the condenser and the discharge port of the compressor, and a suction line may be disposed between the evaporator and the suction port of the compressor. The heat pump system may include a first pressure sensor coupled to the discharge line, a temperature sensor coupled to the discharge line, and a second pressure sensor coupled to the suction line. The heat pump system may include a flash tank positioned at a greater vertical height than the compressor. The flash tank may be configured to receive liquid refrigerant from the condenser and output vapor refrigerant to the compressor. The flash tank may be configured to direct the vapor refrigerant to the compressor and to direct the liquid refrigerant to the evaporator. The heat pump system may further include an expansion valve configured to facilitate the conversion of a portion of the liquid refrigerant from the condenser into a two-phase refrigerant, and a suction valve configured to control a flow of the vapor refrigerant from the flash tank to the compressor. The heat pump system may include a vapor injection line disposed between the flash tank and the compressor. The vapor injection line may be coupled to a top surface of the flash tank. The heat pump system may include a warning line disposed between the flash tank and the vapor injection line. The warning line may be coupled to a side surface of the flash tank. The vertical attachment position of the warning line on the side surface of the flash tank may determine the ratio of vapor to liquid refrigerant in the flash tank. The warning line may have a diameter from 0.1 inches to 2 inches. The diameter may be configurable, and adjustments to diameter may determine the quality of the injected refrigerant. The warning line may be configured to drain liquid refrigerant from the flash tank via gravitational force. The warning line may prevent overcharging during the active charging process by an operator (e.g., an HVAC technician, etc.). For example, once the warning system triggers, the operator would stop charging and may or may not release a little bit of refrigerant to achieve an ideally charged system. The warning line may be further configured to direct excess liquid refrigerant in the flash tank to the compressor to control the amount of liquid refrigerant in the flash tank. The excess liquid refrigerant may reduce the discharge temperature of the compressor.

In another embodiment, a cold climate heat pump system includes a compressor with a suction port and a discharge port, a condenser coupled to the compressor, and an evaporator coupled to the compressor. A discharge line may be disposed between the condenser and the discharge port of the compressor, and a suction line may be disposed between the evaporator and the suction port of the compressor. The cold climate heat pump system may include a first pressure sensor coupled to the discharge line, a temperature sensor coupled to the discharge line, and a second pressure sensor coupled to the suction line. The cold climate heat pump system may include a flash tank positioned at a greater vertical height than the compressor. The flash tank may be configured to receive liquid refrigerant from the condenser and output vapor refrigerant to the compressor. The flash tank may be configured to direct the vapor refrigerant to the compressor and to direct the liquid refrigerant to the evaporator. The cold climate heat pump system may further include an expansion valve configured to facilitate the conversion of a portion of the liquid refrigerant from the condenser into a two-phase refrigerant, and a suction valve configured to control a flow of the vapor refrigerant from the flash tank to the compressor. The cold climate heat pump system may include a vapor injection line disposed between the flash tank and the compressor. The vapor injection line may be coupled to a top surface of the flash tank. The cold climate heat pump system may include a warning line disposed between the flash tank and the vapor injection line. The warning line may be coupled to a side surface of the flash tank. The vertical attachment position of the warning line on the side surface of the flash tank may determine the ratio of vapor to liquid refrigerant in the flash tank. The warning line may be configured to drain liquid refrigerant from the flash tank via gravitational force. The warning line may be further configured to direct excess liquid refrigerant in the flash tank to the compressor to control the amount of liquid refrigerant in the flash tank. The excess liquid refrigerant may reduce the discharge temperature of the compressor.

Referring now to FIG. 1, FIG. 1 is a schematic block diagram of a cold climate heat pump system 100. The cold climate heat pump system 100 may include a compressor 102 with a suction port and a discharge port, a condenser 104 downstream of the compressor 102, and an evaporator 106 upstream of the compressor 102. The compressor 102 may be configured to receive a low pressure vapor refrigerant from the evaporator 106 and discharge a high pressure and high temperature refrigerant to the condenser 104. The condenser 104 may be configured to receive the high pressure and high temperature refrigerant and discharge liquid refrigerant. A discharge line 108 may be disposed between the condenser 104 and the discharge port of the compressor 102. The discharge line 108 may be configured to couple the condenser 104 to the discharge port of the compressor 102. The discharge line 108 may be configured to direct refrigerant from the compressor 102 to the condenser 104. A suction line 110 may be disposed between the evaporator 106 and the suction port of the compressor 102. The suction line 110 may be configured to couple the evaporator 106 to the compressor 102. The suction line 110 may direct vapor refrigerant from the evaporator 106 to the compressor 102.

The cold climate heat pump system 100 may include an accumulator or flash tank 112 and a flash tank inlet line 114 disposed between the condenser 104 and the flash tank 112. The flash tank 112 may be positioned at a greater vertical height than the compressor 102, such that gravitational force may be used to direct liquid refrigerant from the flash tank 112 towards the compressor 102 or other component that has a lower vertical position relative to the flash tank 112. The flash tank 112 may be a cylindrical body such as a tank, a vessel, or any other suitable body configured to house refrigerant in a heat pump system. The flash tank 112 may have a capacity of about 1 liter, about 50 liters, about 100 liters, about 1000 liters, about 5000 liters, or any other suitable capacity. The flash tank 112 may be constructed of any suitable material, which may be opaque, such as steel or aluminum.

One or more expansion valves may be included. For example, an expansion valve 117 may be disposed between the flash tank 112 and the evaporator 106, so as to separate the pressures in the system. Another expansion valve 116 may be disposed along the flash tank inlet line 114 between the condenser 104 and the flash tank 112. The expansion valve 116 may be coupled to the flash tank inlet line 114 and may be configured to facilitate conversion of liquid refrigerant from the condenser 104 into a two-phase refrigerant. For example, as the liquid refrigerant flows from the condenser 104 through the flash tank inlet line 114, it may pass through the expansion valve 116. The expansion valve 116 may reduce or remove pressure to allow a portion of the liquid refrigerant to change state into a vapor refrigerant. The two-phase refrigerant may then flow into the flash tank 112 through the flash tank inlet line 114. When the two-phase refrigerant flows into the flash tank 112, the flash tank 112 may be configured to allow separation of the liquid refrigerant from the vapor refrigerant of the two-phase refrigerant. The liquid refrigerant may settle at the bottom or lower end of the flash tank 112 and the vapor refrigerant may rise above the liquid refrigerant in the flash tank 112 toward an upper end of the flash tank 112.

The cold climate heat pump system 100 may include a flash tank outlet line 118. The flash tank outlet line 118 may be disposed between the flash tank 112 and the evaporator 106. The flash tank outlet line 118 may be optionally coupled to a side surface of the flash tank 112. The flash tank 112 may be configured to direct the liquid refrigerant in the flash tank 112 to the evaporator 106 via the flash tank outlet line 118. Gravitational force may be used to separate the phases, and pressure differences may drive or direct the liquid refrigerant from the flash tank 112 to the evaporator 106 (e.g., as refrigerant is suctioned by the compressor, etc.).

The cold climate heat pump system 100 may include a vapor injection line 120. The vapor injection line 120 may be disposed between the flash tank 112 and the compressor 102. The vapor injection line 120 may be coupled to a top surface, or an upper surface, of the flash tank 112. The flash tank 112 may be configured to direct the vapor refrigerant in the flash tank 112 to a vapor injection port at an intermediate location on the compressor 102 via the vapor injection line 120. By injecting the vapor into the compressor 102, the discharge temperature of the compressor 102 may decrease, which improves the efficiency and capacity of the compressor 102 and prevents degradation of the compressor 102 in cold climates.

The cold climate heat pump system 100 may include a warning line 122 disposed between the flash tank 112 and the vapor injection line 120. The warning line 122 may be a tube or a pipe that may be straight or may include any number of bends and may have at least one angle. The warning line 122 may be configured to prevent overcharging of the flash tank 112 by providing a pathway to remove excess liquid refrigerant from the flash tank 112. The warning line 122 may be positionable at different vertical attachment points along a side surface of the flash tank 112, thereby allowing for configurable maximum amounts of liquid refrigerant that can be stored in the flash tank 112. For example, the lower the vertical attachment position of the warning line 122, the lower the amount of liquid refrigerant that is stored in the flash tank 112.

The warning line 122 may be coupled to a side surface of the flash tank 112. In some embodiments, the warning line 122 may be coupled to the flash tank 112 at a higher vertical attachment point than the flash tank outlet line 118. In other embodiments, the warning line 122 may be coupled to a lower vertical attachment point than the flash tank outlet line 118. The vertical attachment position of the warning line 122 on the side surface of the flash tank 112 may determine the ratio of vapor to liquid refrigerant in the flash tank 112, as described in greater detail with reference to FIGS. 4A and 4B. The warning line 122 may be configured to control the level of liquid refrigerant in the flash tank 112 by draining excess liquid refrigerant from the flash tank 112 to prevent the cold climate heat pump system 100 from operating with a full flash tank 112, as described in greater detail with reference to FIG. 3. The warning line 122 may have a diameter of about 0.1 inches to about 3 inches, such as between about 0.1 inches and 2 inches, about 0.5 inches to about 1.5 inches, about 0.75 inches to about 1.25 inches, about 1 inch, and so forth.

The cold climate heat pump system 100 may further include a temperature sensor 124 coupled to the discharge line 108, a first pressure sensor 126 coupled to the discharge line 108, and a second pressure sensor 128 coupled to the suction line 110. The temperature sensor 124 may be configured to monitor the discharge temperature of the compressor 102. The first pressure sensor 126 may be configured to monitor the discharge pressure of the compressor 102, and the second pressure sensor 128 may be configured to monitor the suction pressure of the compressor 102. The temperature sensor 124, the first pressure sensor 126, and the second pressure sensor 128 may be in communication with a controller (not shown).

The cold climate heat pump system 100 may further include a suction valve 130 configured to control the flow of the vapor refrigerant from the flash tank 112 to the compressor 102 via the vapor injection line 120. The suction valve 130 may be disposed between the flash tank 112 and the compressor 102. The suction valve 130 may be coupled to the vapor injection line 120. The controller (not shown) may be configured to open and close the suction valve 130 based on data received from the temperature sensor 124, the first pressure sensor 126, and the second pressure sensor 128. When the vapor refrigerant from the flash tank 112 reaches the compressor 102, the temperature of the compressor 102 may be reduced. If the discharge temperature of the compressor 102 is equal to or less than a predetermined discharge temperature, the controller may close the suction valve 130 to stop the flow of the vapor refrigerant from the flash tank 112 to the compressor 102. If the discharge temperature of the compressor 102 is greater than the predetermined discharge temperature, the controller may open the suction valve 130 to allow the vapor refrigerant to flow from the flash tank 112 through the vapor injection line 120 and into the vapor injection port of the compressor 102 to reduce the discharge temperature of the compressor 102. The vapor injection may also be controlled based on other conditions, such as ambient temperature. The warning system described herein may act as a secondary control, which may optionally overwrite conventional controls.

Figure 2:
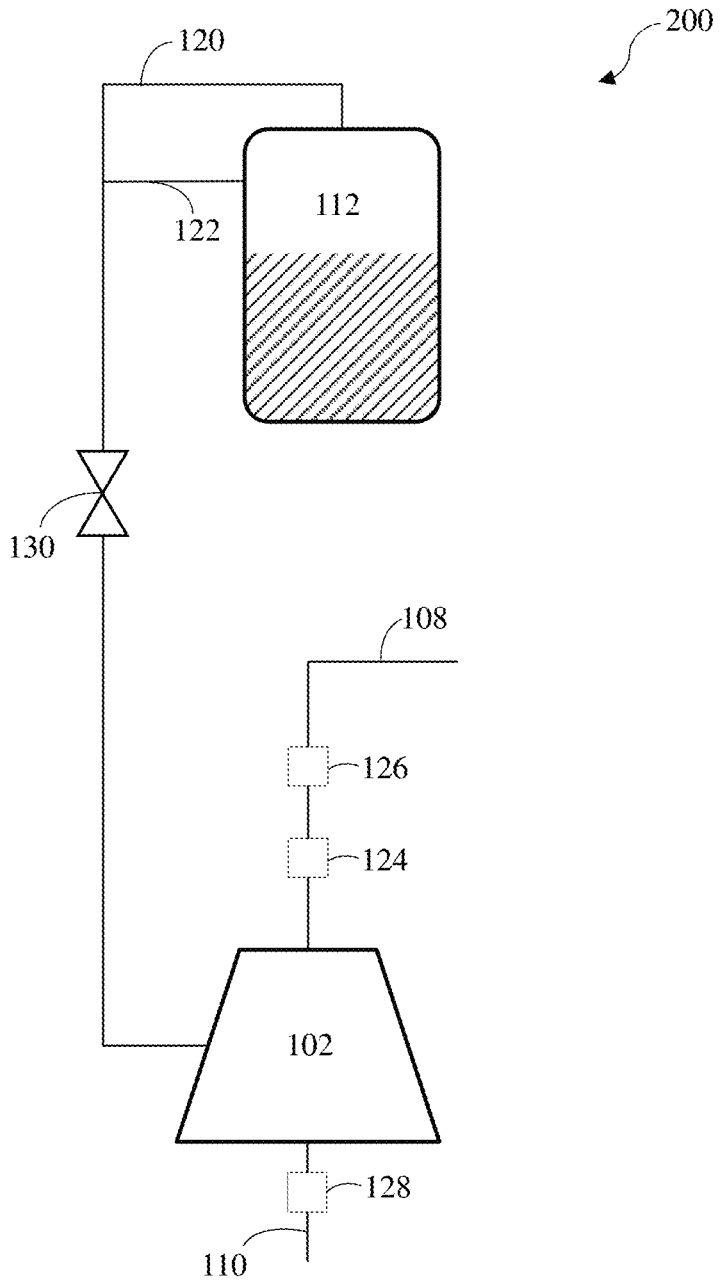
FIG. 2 is a schematic block diagram of a heat pump system with a partially filled flash tank.

FIG. 2 is a schematic block diagram of a heat pump system 200 with a partially filled flash tank 112. The flash tank 112 may have a user-selected ratio of vapor to liquid refrigerant when the level of liquid refrigerant falls below the warning line 122, as shown in FIG. 2. When the level of liquid refrigerant does not reach the warning line 122, all of the vapor refrigerant in the flash tank 112 may be directed to the vapor injection port of the compressor 102 via the vapor injection line 120 and the liquid refrigerant in the flash tank 112 may be directed to the evaporator 106 via the flash tank outlet line 118 to maintain the desired ratio of vapor to liquid refrigerant in the flash tank 112. The vertical attachment position of the warning line 122 on the side surface of the flash tank 112 may determine the ratio of vapor to liquid refrigerant in the flash tank 112, as described in greater detail with reference to FIGS. 4A and 4B.

Figure 3:
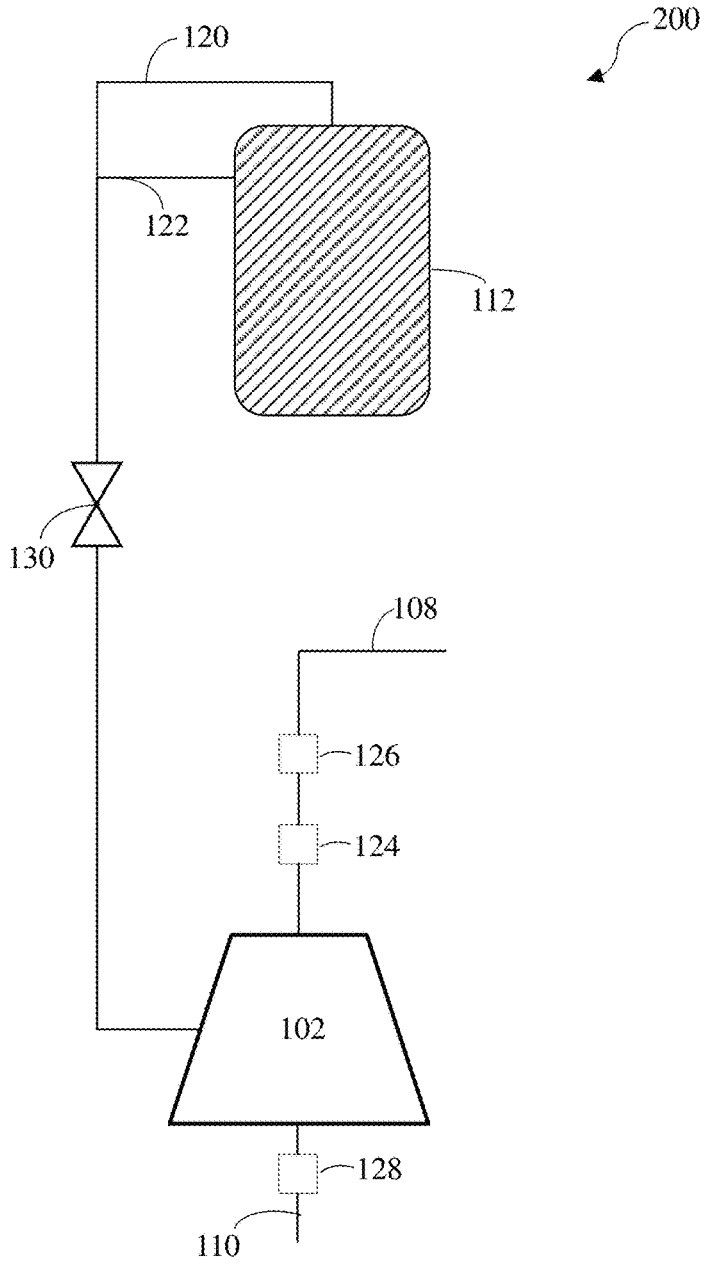
FIG. 3 is a schematic block diagram of the heat pump system of FIG. 2 with a full flash tank.

FIG. 3 is a schematic block diagram of a heat pump system 200 with a full flash tank 112. When the level of liquid refrigerant in the flash tank 112 reaches or goes above the warning line 122, there may be an excess amount of liquid refrigerant in the flash tank 112. There may be an excess amount of liquid refrigerant in the flash tank 112 when the liquid refrigerant occupies about 80% to about 100% of the flash tank 112 capacity, resulting in the flash tank 112 being almost full or full. Having an excess amount of liquid refrigerant in the flash tank 112 may put the heat pump system 200 at risk of becoming overcharged. When there is excess liquid refrigerant in the flash tank 112, the warning line 122 may be configured to passively direct the excess liquid refrigerant in the flash tank 112 to the compressor 102 to control the amount of liquid refrigerant in the flash tank 112 via gravitational force that pulls the liquid refrigerant down through the warning line 122, as shown in FIG. 3. The warning line 122 may be coupled to the vapor injection line 120 such that the excess liquid refrigerant may be directed from the warning line 122 into the vapor injection line 120 and then into the vapor injection port of the compressor 102. The warning line 122 may drain the excess liquid refrigerant from the flash tank 112 to the compressor 102 via gravitational force because the flash tank 112 is positioned at a greater vertical height than the compressor 102.

Because the diameter of the warning line 122 may be about 0.1 inches to about 2 inches in some embodiments, the warning line 122 may allow up to about 20% of the liquid refrigerant in the flash tank 112 to reach the compressor 102. Other embodiments may have different diameters or configurations. Moreover, by directing only the excess liquid refrigerant in the flash tank 112 that reaches the warning line 122 to the compressor 102, the amount of liquid refrigerant that reaches the compressor 102 is reduced, in some instances, by about 80%. Furthermore, because the warning line 122 continuously drains the liquid refrigerant, the warning line 122 may prevent the flash tank 112 from becoming full, reducing the risk of overcharging the heat pump system 200. Therefore, the warning line 122 may minimize the risk of overcharging the heat pump system 200 and may mitigate the harms, such as damaging the compressor 102, in instances where the heat pump system 200 is overcharged. Because the warning line 122 reduces the risk of overcharging the heat pump system 200, the size of the flash tank 112 may be reduced, providing additional cost savings.

When the flash tank 112 is almost full or full, the vapor injection line 120 may continue to direct the vapor refrigerant in the flash tank 112 to the compressor 102. The amount of vapor refrigerant that reaches the compressor 102 may be reduced by the amount of excess liquid refrigerant that is directed to the compressor 102. The flash tank outlet line 118 may continue to direct the liquid refrigerant that does not reach the warning line 122 to the evaporator 106 when the flash tank 112 is almost full or full. By continuing to direct the liquid refrigerant to the evaporator 106, the flash tank 112 may return to the user-selected ratio of vapor to liquid refrigerant at a faster rate, further reducing the risk of overcharging the heat pump system 200 as well as further minimizing the amount of liquid refrigerant that reaches the compressor 102.

The excess liquid refrigerant that reaches the compressor 102 may cool the discharge temperature of the compressor 102, which may improve the efficiency and capacity of the compressor 102 and may further prevent degradation of the compressor 102 in cold climates. The suction valve 130 may be configured to control the flow of the excess liquid refrigerant from the flash tank 112 to the compressor 102. If the discharge temperature of the compressor 102 is equal to or less than the predetermined discharge temperature after the excess liquid refrigerant reaches the compressor 102, the controller may close the suction valve 130 to stop the flow of the excess liquid refrigerant to the compressor 102. If the suction valve 130 is closed, the liquid refrigerant may still continue to flow through the flash tank outlet line 118 to the evaporator 106.

Figure 4A:
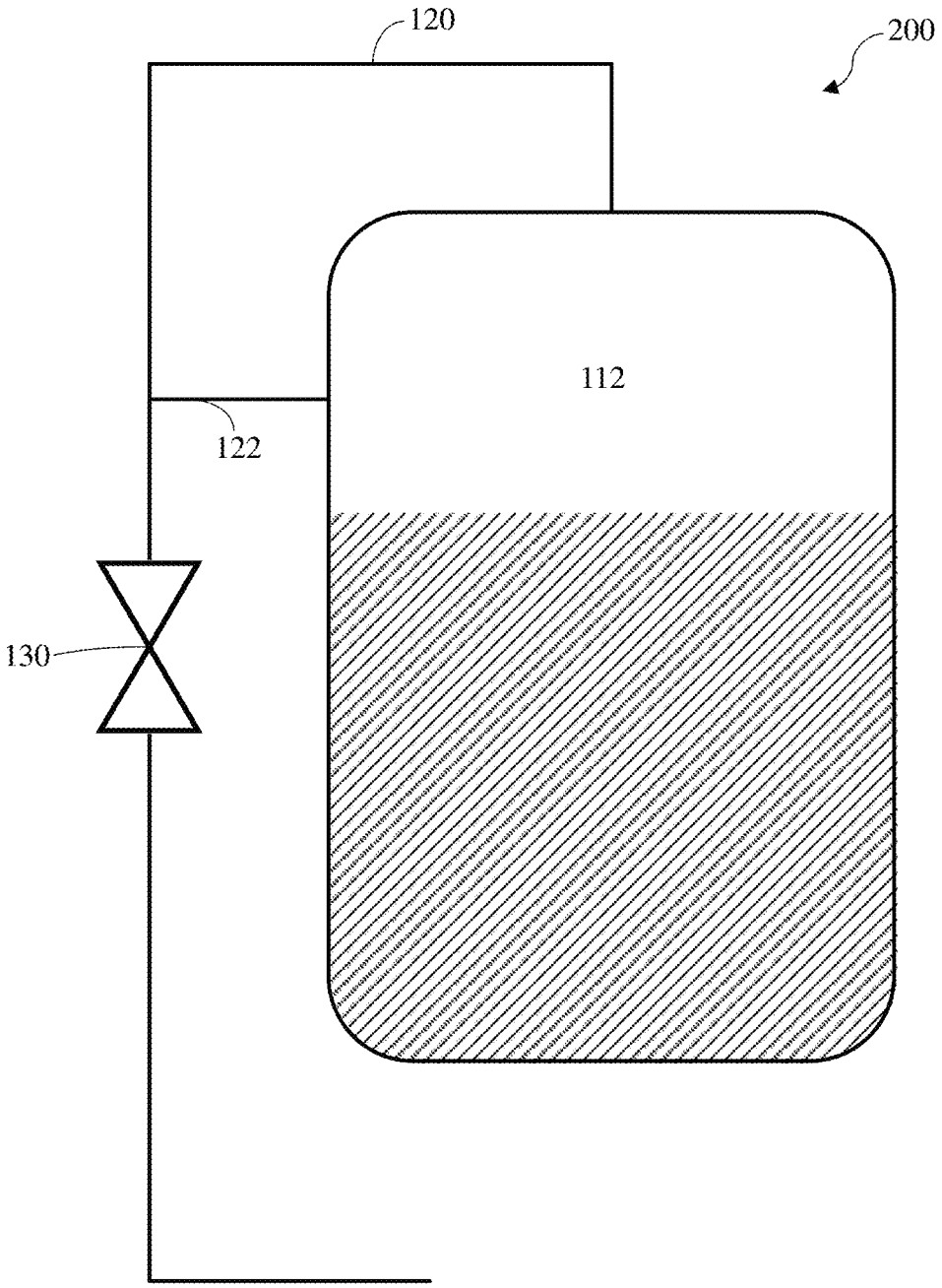
FIG. 4A is a schematic enlarged front view of the flash tank of the heat pump system of FIG. 2 having a warning line at a first vertical attachment position.
Figure 4B:
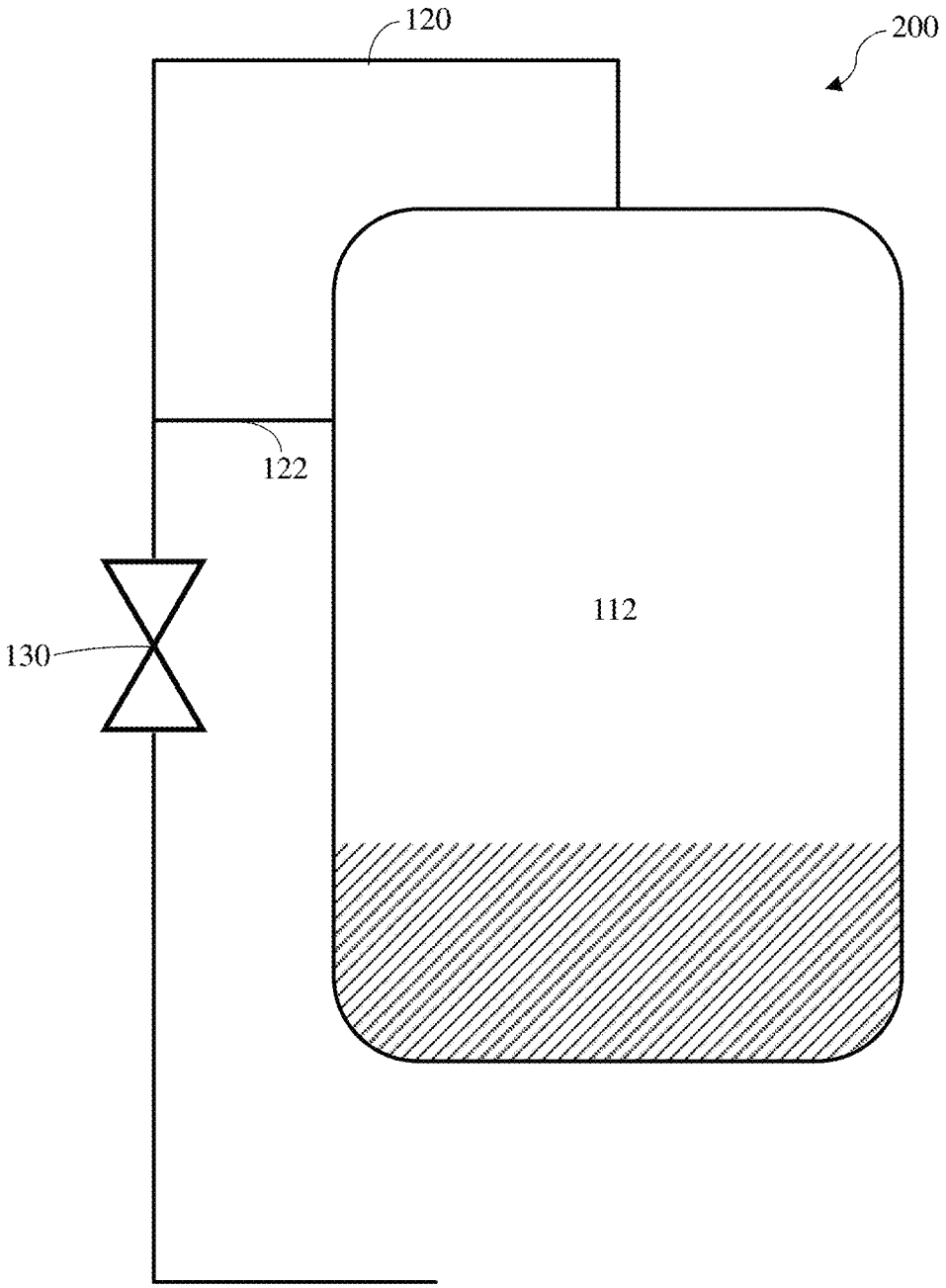
FIG. 4B is a schematic enlarged front view of the flash tank of the heat pump system of FIG. 2 having a warning line at a second vertical attachment position.
Figure 4C:
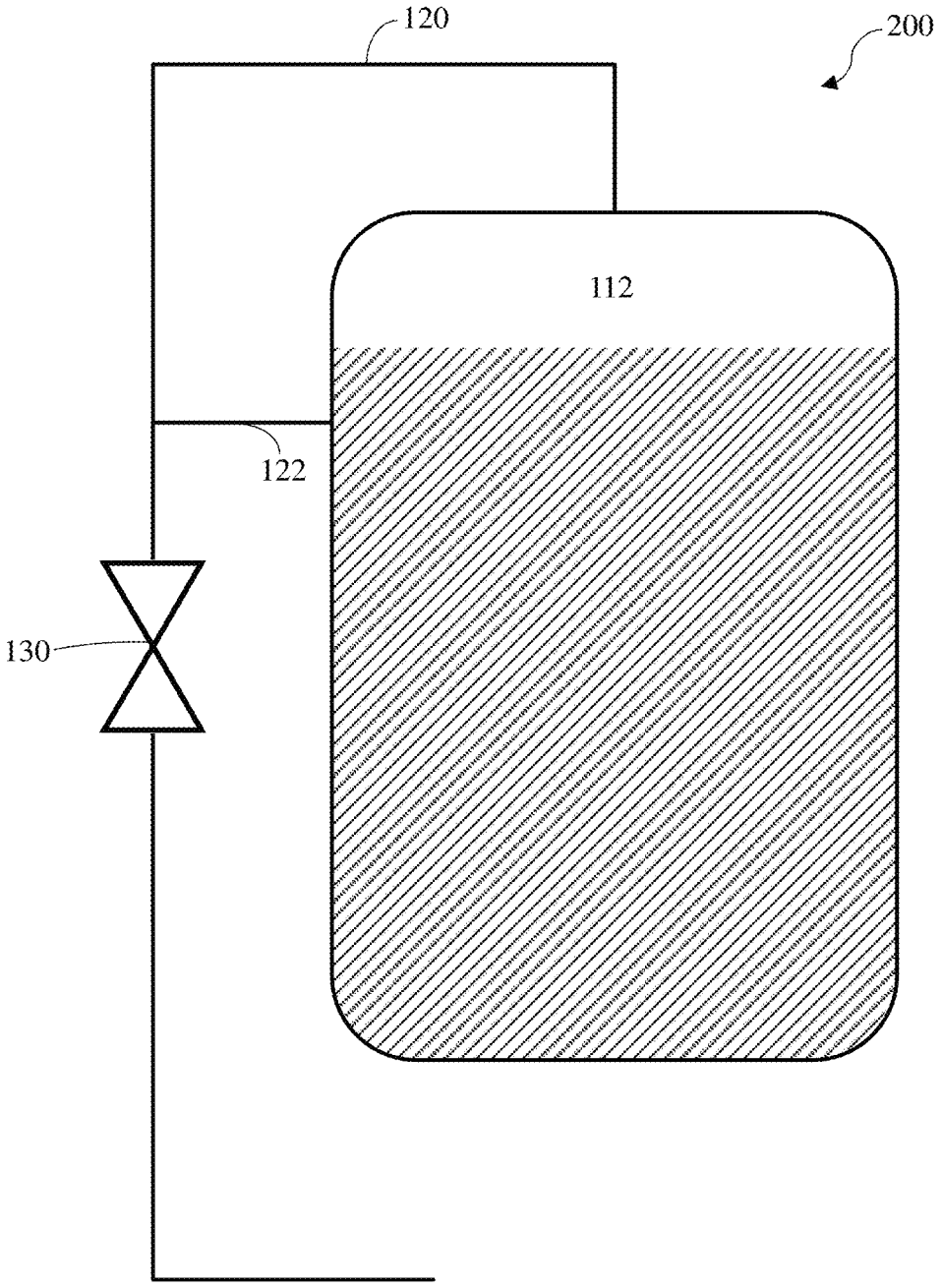
FIG. 4C is a schematic enlarged front view of the flash tank of FIG. 4B with a liquid level above the warning line, but below a full level.

FIG. 4A is a schematic enlarged front view of the flash tank 112 of the heat pump system 200 of FIG. 2 having the warning line 122 at a first vertical attachment position. FIG. 4B is a schematic enlarged front view of the flash tank 112 of the heat pump system 200 of FIG. 2 having the warning line 122 at a second vertical attachment position. FIG. 4C is a schematic enlarged front view of the flash tank of FIG. 4B with a liquid level above the warning line, but below a full level. Certain dimensions such as the diameter and the vertical attachment position of the warning line 122 may be configured to control the ratio of vapor to liquid refrigerant in the flash tank 112 and the amount of liquid refrigerant that reaches the compressor 102, as shown in FIGS. 4A-4C.

The warning line 122 may be coupled at any vertical attachment position on the side surface of the flash tank 112 to achieve a desired vapor to liquid refrigerant ratio. For example, FIG. 4A illustrates the warning line 122 coupled to the flash tank 112 at a first vertical attachment position. If the vertical attachment position of the warning line 122 is disposed closer to the top surface of the flash tank 112, as shown in FIG. 4A, the ratio of vapor to liquid refrigerant may be lower. FIG. 4B illustrates the warning line 122 coupled to the flash tank 112 at a second vertical attachment position. If the vertical attachment position of the warning line 122 is disposed closer to the bottom surface of the flash tank 112, as shown in FIG. 4B, the ratio of vapor to liquid refrigerant may be higher. The side surface of the flash tank 112 may have one or more attachment points that allow the user to adjust the position of the warning line 122 to the desired vertical attachment position. The warning line 122 may be coupled to the side surface of the flash tank 112 using any suitable mechanism such as standard pipe fitting or fluid coupling. FIG. 4C depicts a liquid level above the warning line, but below a full level, indicating that the flash tank is overcharged, and providing a warning before the flash tank becomes full.

The vertical attachment position of the warning line 122 may be adjusted to generate the desired vapor to liquid refrigerant ratio in the flash tank 112. The warning line 122 may be used to drain the excess liquid refrigerant at any vertical attachment position, resulting in a reduced level of liquid refrigerant in the flash tank 112. The user-selected ratio of vapor to liquid refrigerant may therefore be maintained. Therefore, the warning line 122 may mitigate the risk of overcharging the heat pump system 200 and may protect the compressor 102 by reducing the amount of liquid refrigerant that reaches the compressor 102 at any vertical attachment position on the side surface of the flash tank 112. Furthermore, because the warning line 122 may be attached at any vertical attachment position on the flash tank 112, the warning line 122 may be used for all sizes of flash tanks, making the warning line 122 adaptable to flash tanks or accumulators used in large industrial settings, in residential settings, and in any other desired settings.

It should be apparent that the foregoing relates only to certain embodiments of the present disclosure and that numerous changes and modifications may be made herein by one of ordinary skill in the art without departing from the general spirit and scope of the disclosure.

Although specific embodiments of the disclosure have been described, numerous other modifications and alternative embodiments are within the scope of the disclosure. For example, any of the functionality described with respect to a particular device or component may be performed by another device or component. Further, while specific device characteristics have been described, embodiments of the disclosure may relate to numerous other device characteristics. Further, although embodiments have been described in language specific to structural features and/or methodological acts, it is to be understood that the disclosure is not necessarily limited to the specific features or acts described. Rather, the specific features and acts are disclosed as illustrative forms of implementing the embodiments. Conditional language, such as, among others, "can," "could," "might," or "may," unless specifically stated otherwise, or otherwise understood within the context as used, is generally intended to convey that certain embodiments could include, while other embodiments may not include, certain features, elements, and/or steps. Thus, such conditional language is not generally intended to imply that features, elements, and/or steps are in any way required for one or more embodiments.

That which is claimed is:

1. A heat pump system comprising:

a compressor comprising a suction port and a discharge port;

a condenser;

a flash tank configured to receive liquid refrigerant from the condenser and output vapor refrigerant to the compressor, wherein the flash tank is positioned at a greater vertical height than the compressor;

a vapor injection line disposed between the flash tank and the compressor; and a warning line disposed between the flash tank and the vapor injection line, wherein the warning line is configured to drain liquid refrigerant from the flash tank.

2. The heat pump system of claim 1, wherein the vapor injection line is coupled to a top surface of the flash tank.

3. The heat pump system of claim 2, wherein the warning line is coupled to a side surface of the flash tank.

4. The heat pump system of claim 3, wherein a vertical attachment position of the warning line on the side surface determines a ratio of vapor to liquid refrigerant in the flash tank.

5. The heat pump system of claim 1, further comprising:

a discharge line disposed between the condenser and the discharge port of the compressor;

an evaporator coupled to the compressor; and a suction line disposed between the evaporator and the suction port of the compressor.

6. The heat pump system of claim 5, further comprising:

a first pressure sensor coupled to the discharge line;

a temperature sensor coupled to the discharge line; and a second pressure sensor coupled to the suction line.

7. The heat pump system of claim 1, wherein the flash tank is configured to:

direct the vapor refrigerant to the compressor; and direct the liquid refrigerant to the evaporator.

8. The heat pump system of claim 1, wherein the warning line drains the liquid refrigerant from the flash tank via a pressure differential between the flash tank and the compressor.

9. The heat pump system of claim 1, further comprising:

an expansion valve configured to facilitate the conversion of a portion of the liquid refrigerant from the condenser into a two-phase refrigerant; and a suction valve configured to control a flow of the vapor refrigerant from the flash tank to the compressor.

10. The heat pump system of claim 1, wherein the warning line has a diameter from 0.1 inches to 2 inches.

11. The heat pump system of claim 1, wherein the warning line is further configured to direct excess liquid refrigerant in the flash tank to the compressor, and to indicate an amount of liquid refrigerant in the flash tank.

12. The heat pump system of claim 11, wherein the excess liquid refrigerant reduces a discharge temperature of the compressor.

13. A cold climate heat pump system comprising:

a compressor comprising a suction port and a discharge port;

a condenser;

a discharge line disposed between the condenser and the discharge port of the compressor;

an evaporator coupled to the compressor;

a suction line disposed between the evaporator and the suction port of the compressor;

a flash tank configured to receive liquid refrigerant from the condenser and output vapor refrigerant to the compressor, wherein the flash tank is positioned at a greater vertical height than the compressor;

a vapor injection line disposed between the flash tank and the compressor, wherein the vapor injection line is coupled to a top surface of the flash tank; and a warning line disposed between the flash tank and the vapor injection line, wherein the warning line is configured to drain liquid refrigerant from the flash tank, and wherein the warning line is coupled to a side surface of the flash tank.

14. The cold climate heat pump system of claim 13, wherein a vertical attachment position of the warning line on the side surface determines a ratio of vapor to liquid refrigerant in the flash tank.

15. The cold climate heat pump system of claim 13, further comprising:

a first pressure sensor coupled to the discharge line;

a temperature sensor coupled to the discharge line; and a second pressure sensor coupled to the suction line.

16. The cold climate heat pump system of claim 13, wherein the flash tank is configured to:

direct the vapor refrigerant to the compressor; and direct the liquid refrigerant to the evaporator.

17. The cold climate heat pump system of claim 13, wherein the warning line drains the liquid refrigerant from the flash tank via a pressure differential between the flash tank and the compressor.

18. The cold climate heat pump system of claim 13, further comprising:

an expansion valve configured to facilitate the conversion of a portion of the liquid refrigerant from the condenser into a two-phase refrigerant; and a suction valve configured to control a flow of the vapor refrigerant from the flash tank to the compressor.

19. The cold climate heat pump system of claim 13, wherein the warning line is further configured to direct excess liquid refrigerant in the flash tank to the compressor, and to indicate an amount of liquid refrigerant in the flash tank.

20. The cold climate heat pump system of claim 19, wherein the excess liquid refrigerant reduces a discharge temperature of the compressor.

* * * * *